US005977914A

United States Patent [19]

Harano

[11] Patent Number: 5,977,914

[45] Date of Patent: Nov. 2, 1999

[54] MICROSTRIP ANTENNA

[75] Inventor: Nobuya Harano, Shizuoka, Japan

[73] Assignee: NEC Corporation, Tokyo, Japan

[21] Appl. No.: 08/855,573

[22] Filed: May 13, 1997

[30] Foreign Application Priority Data

May 15, 1996 [JP] Japan ..... 8-120148

[51] Int. Cl.[6] ..... H01Q 1/38; H01Q 1/42

[52] U.S. Cl. ..... 343/700 MS; 343/893; 343/832; 343/834; 343/789

[58] Field of Search ..... 343/893, 700 MS, 343/832, 834, 846, 848, 789, 829, 853

[56] References Cited

U.S. PATENT DOCUMENTS

| | | | |
|---|---|---|---|
| 5,434,581 | 7/1995 | Raguenet et al. | 343/700 MS |
| 5,497,164 | 3/1996 | Croq | 343/700 MS |
| 5,552,798 | 9/1996 | Dietrich et al. | 343/893 |

FOREIGN PATENT DOCUMENTS

| | | | |
|---|---|---|---|
| 2-142203 | 5/1990 | Japan | 13/8 |
| 3-166802 | 7/1991 | Japan . | |
| 4-120903 | 4/1992 | Japan . | |
| 4-160801 | 6/1992 | Japan . | |
| 4-207303 | 7/1992 | Japan . | |
| 4-121110 | 10/1992 | Japan | 15/14 |

*Primary Examiner*—Don Wong
*Assistant Examiner*—James Clinger
*Attorney, Agent, or Firm*—Whitham, Curtis & Whitham

[57] ABSTRACT

The microstrip antenna of the present invention has a basic structure of a ground conductor plate, dielectric substrate and radiation conductor plate laminated together. On the dielectric substrate, upon which the radiation conductor plate is formed, two radio wave reflectors are placed parallel to each other facing across the radiation conductor plate. The two surfaces of the two radio wave reflectors that are facing each other are either perpendicular to the dielectric substrate, or else the interval between the two surfaces enlarges as they depart from the dielectric substrate. Due to this structure, by increasing the variation in antenna directivity, the antenna can be made less susceptible to noise generated from noise sources in the antenna vicinity. Moreover, the antenna can be small-sized since the radio wave reflectors can be placed close to the radiation conductor plate.

4 Claims, 9 Drawing Sheets

MICROSTRIP ANTENNA

BACKGROUND OF THE INVENTION

1. Field of the Invention

This invention is related to a microstrip antenna having a plate-shaped radio frequency radiation conductor.

2. Description of the Related Art

The microstrip antennas used in conventional portable radio equipment are equipped with a basic structure as indicated, for example, in Japanese Patent Application Laid-Open No. 3-166802. In brief, this is a structure in which a ground conductor plate such as a conductor plate of copper foil, etc., a dielectric substrate such as a resin substrate, and a radiation conductor plate of the same material as the ground conductor plate but with a smaller area are laminated into layers. The radiation conductor plate is square or rectangular and is positioned roughly on the central part of the dielectric substrate. The radiation conductor plate is connected to the ground conductor plate by multiple through-holes formed on its periphery. A feeding point is formed somewhat off from the central part of the radiation conductor plate toward the side of the through holes.

This antenna is characterized by having a directional pattern that radiates direct waves of roughly uniform strength in all directions of the radiation surface (plate surface) of a radiation conductor plate 1. It has antenna gain in the direction to the rear of the radiation conductor plate as well.

With a radio device that transmits and receives radio signals by an antenna as described above, it is generally necessary to minimize the reception of noise generated from sources of noise in the vicinity. Conventionally, in order to avoid the influence of noise, noise shields have been employed or the antenna has been placed in a position where it is less likely to be influenced by noise. However, there is a problem with noise source shields, in that there is a large burden imposed by the attendant increase in cost. There is also a problem with placing the antenna in a position where it is less likely to be influenced by noise, in that this is limited by the size of the antenna.

It is also possible to lessen the noise reception of a radio device by reducing antenna gain in the direction of the noise source, by controlling the antenna directivity by using a microstrip antenna with an array structure, like that in Japanese Patent Application Laid-Open No. 4-160801. Moreover, directivity can be sharpened to some extent by making the area of the ground conductor plate considerably larger than the radiation conductor plate.

However, devices with these structures require a large area, making it difficult to apply them in radio devices for portable use, for which small size and light weight are demanded.

SUMMARY OF THE INVENTION

The purpose of the present invention is to solve the above-mentioned problem by providing a microstrip antenna that is both small-sized and also has the desired directivity.

In brief, the microstrip antenna of the present invention has a dielectric baseplate, a ground conductor plate formed on one side of the surface of the dielectric plate, a radiation conductor plate that is formed in the central part on the surface of another side of the dielectric substrate and that has an area smaller than the ground conductor plate, and radio wave reflectors that reflect part of the radio waves radiated from the radiation conductor plate. The said radiation conductor plate is short-circuited to the said ground conductor plate and also connected to a feeding line. It is preferable if the said radio wave reflector is formed on the border on the surface of the said dielectric substrate and at a fixed interval from the radiation conductor plate.

Two radio wave reflectors can be placed facing each other on the surface of the dielectric substrate border, so that they hem in the radiation conductor plate. The two faces of the radio wave reflectors that are facing each other may be planar surfaces perpendicular to the surface of the radiation conductor plate, or, they may be structured so that the interval between the two surfaces enlarges as they depart from the surface of the dielectric substrate in the perpendicular direction.

A microstrip antenna with this kind of structure can be materialized in a small-sized shape and with the desired directivity.

BRIEF DESCRIPTION OF THE DRAWINGS

The above and other objects, features and advantages of the present invention will become apparent from the following detailed description when taken with the accompanying drawings in which:

FIG. 4A is a cross-section in a direction parallel to the radio wave reflectors and FIG. 4B is a cross-section in a direction perpendicular to the radio wave reflectors.

AND

Figure 9:
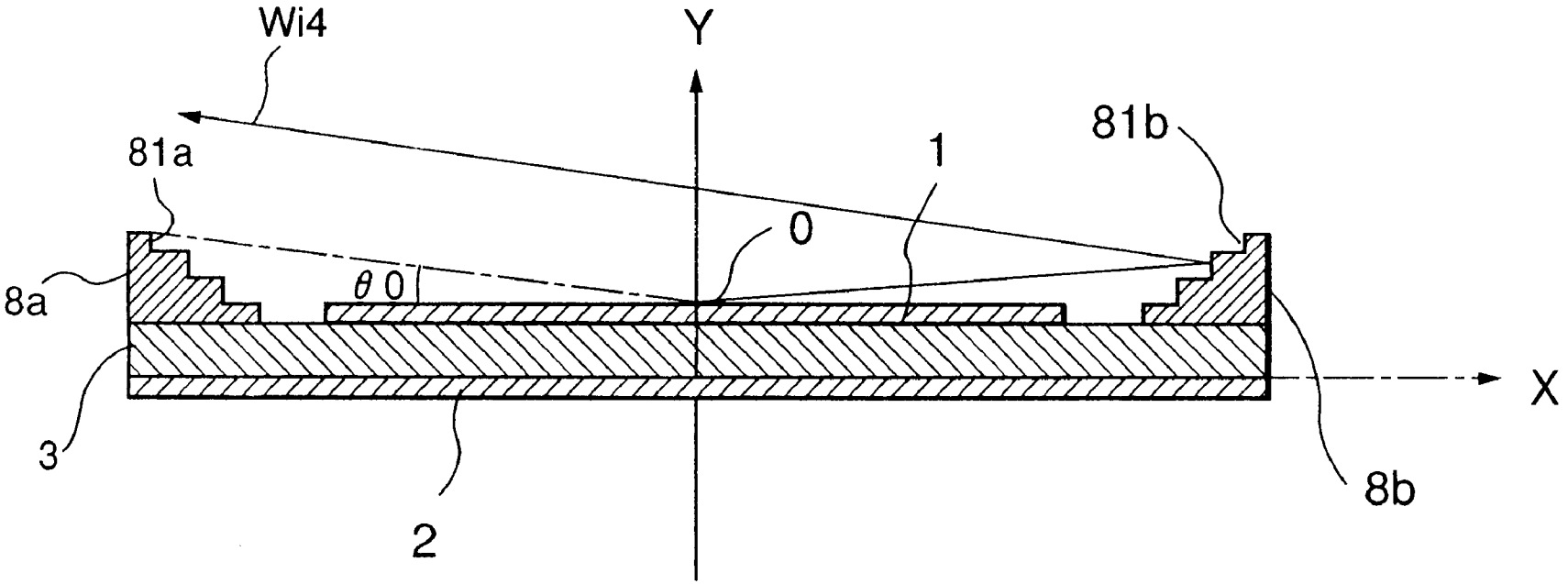

FIG. 9 is a cross-section showing another preferred embodiment of the microstrip antenna of the present invention.

DETAILED DESCRIPTION OF THE PREFERRED EMBODIMENT

Figure 1:
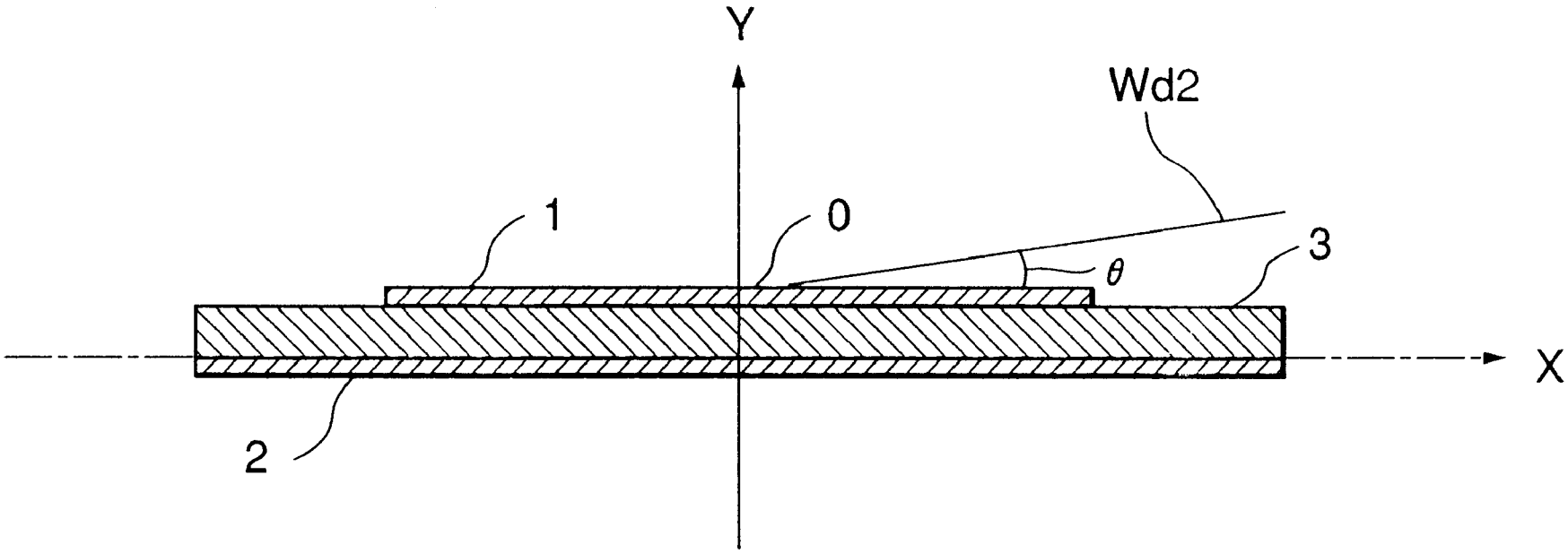
FIG.1 PRIOR ART
FIG. 1 is a cross-section of a conventional microstrip antenna.
Figure 2:
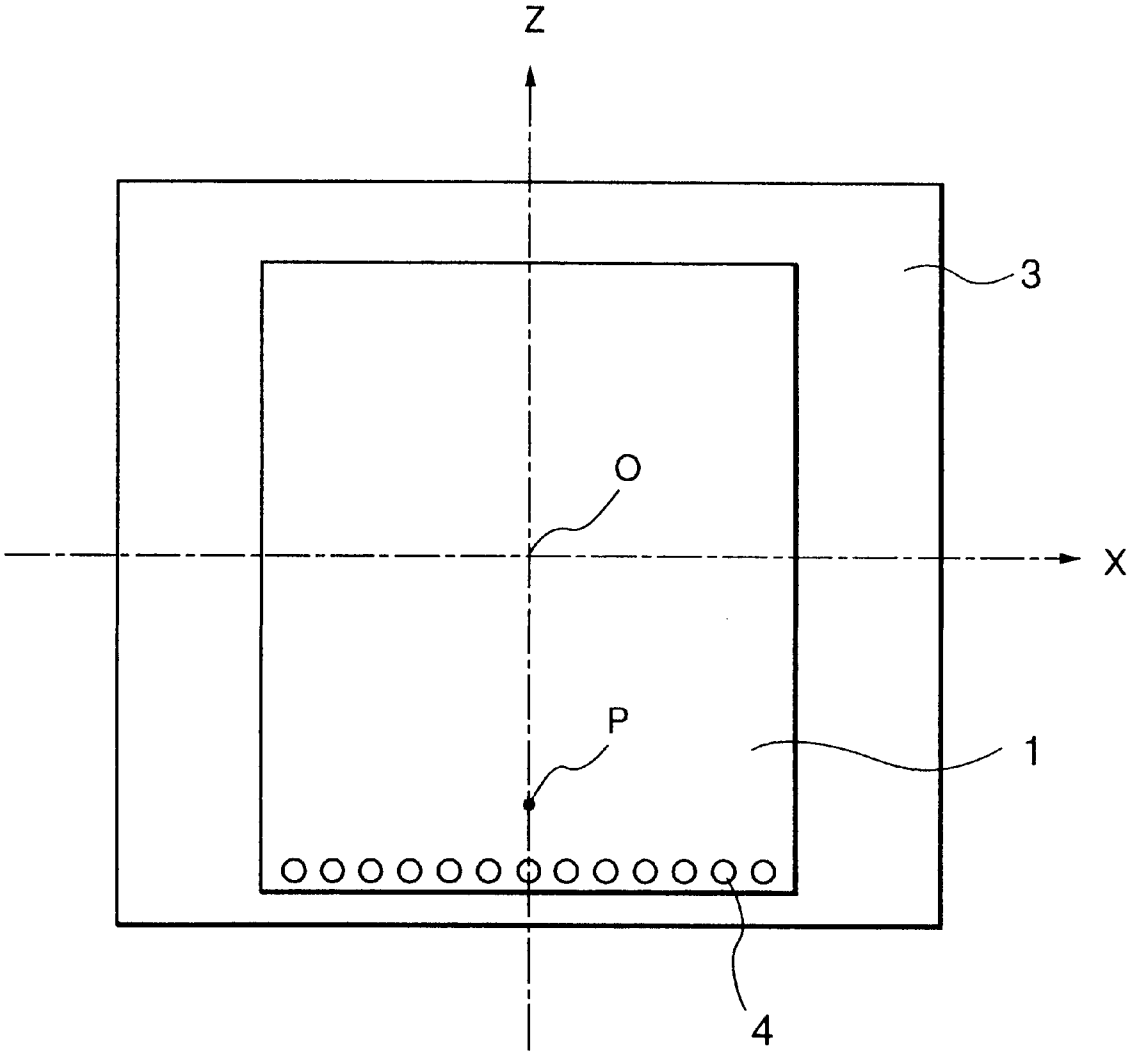
FIG.2 PRIOR ART
FIG. 2 is a plan view of the microstrip antenna of FIG. 1.

First, an explanation will be given of a conventional microstrip antenna in order to provide a comparison to the present invention. FIGS. 1 and 2 are respectively a cross-section and plan view of a conventional microstrip antenna. A ground conductor plate 2 such as a conductor plate of copper foil, a dielectric substrate 3 such as a resin substrate and a radiation conductor plate 1 that is of the same material as the ground conductor plate 2 but with a smaller area are successively laminated in layer form. The radiation conductor plate 1 is nearly square in shape, and multiple through holes 4 are formed in a line near one of its edges, connecting it to the ground conductor plate 2. A feeding point P is placed in a line connecting the center O of the radiation conductor plate 1 and the center of the side on which the said through holes are formed.

Figure 3:
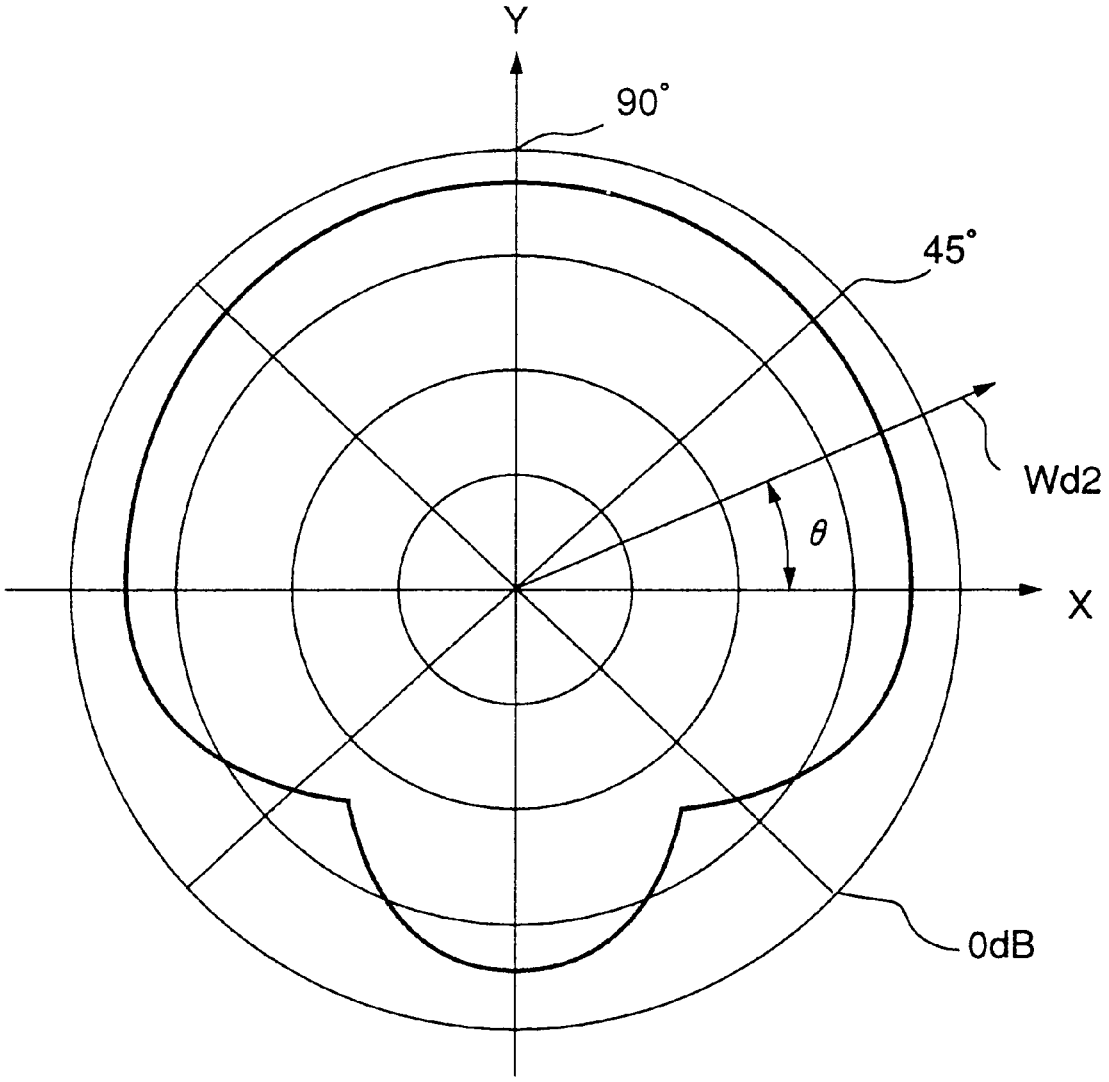
FIG.3 PRIOR ART
FIG. 3 is a directivity pattern of the microstrip antenna of FIG. 1.

FIG. 3 shows a directivity pattern of the said microstrip antenna. The width of each of the concentric circles represents 10 dB. The Y axis is the axis in the direction perpendicular to the plate of the radiation conductor plate from its center. This antenna is characterized by having a directivity pattern in which a direct wave Wd2 is radiated in roughly the same strength in all directions on the radiation surface (plate surface) of the radiation conductor plate 1, for example, at all angles θ from the X axis to the Y axis. It also has antenna gain to some extent in the −Y direction as well.

With a radio device that transmits and receives by the said antenna, directivity is roughly uniform, so that the radio device is easily influenced by noise generated from noise sources in the surroundings of the antenna.

Figure 4A:
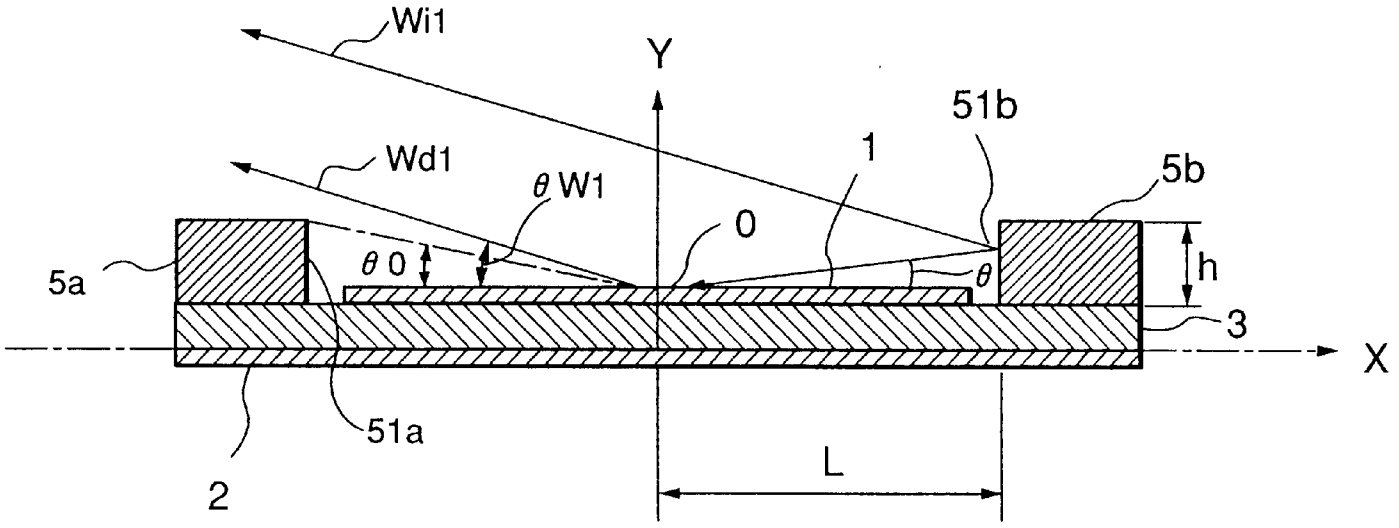
FIGS. 4A and 4B are cross-sections showing a preferred embodiment of a microstrip antenna of the present invention.
Figure 4B:
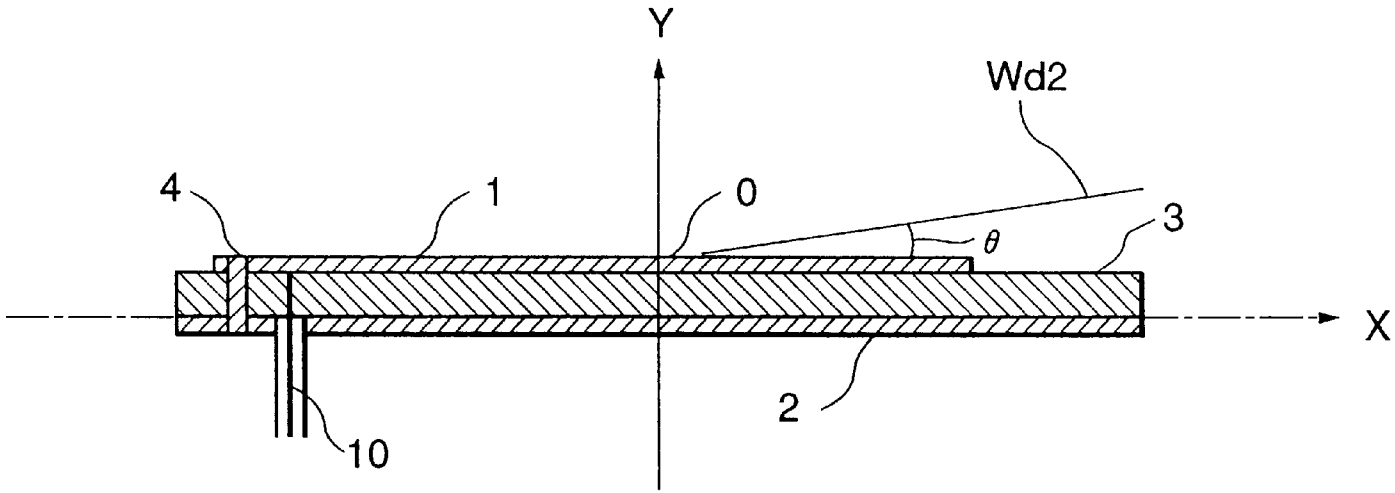
Figure 5:
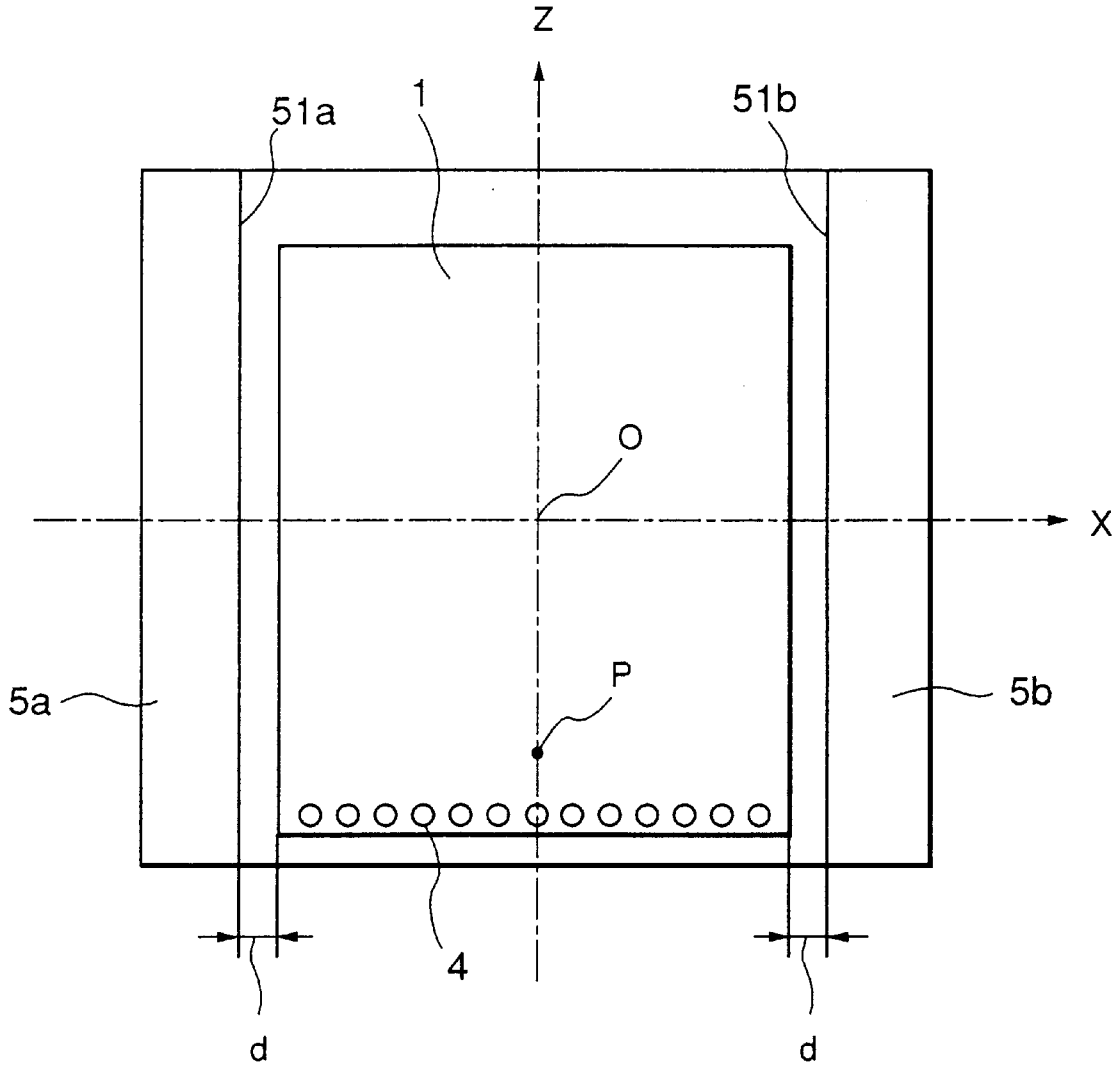
FIG. 5 is a plan view showing a preferred embodiment of the microstrip antenna of the present invention in FIG. 4.

The microstrip antenna of the present invention will now be explained by referring to FIGS. 4, 5, and 6. As FIG. 4A shows, a dielectric substrate 3 is formed on a ground conductor plate 2, and a radiation conductor plate 1 is placed in the central part of the dielectric substrate 3. Two metal bodies, that is radio wave reflectors 5*a*, 5*b*, are placed in parallel in facing positions on the dielectric substrate 3, hemming in the radiation conductor plate 1. The radio wave reflectors 5*a*, 5*b* are rectangular parallelepipeds; surfaces 51*a* and 51*b* (reflector surfaces) face each other and are perpendicular to the dielectric substrate 3. They are separated from the radiation conductor plate 1 by a fixed interval d. FIG. 4B is a cross-section in the direction of the X axis. A feeding line 10 is connected to a feeding point P from the ground conductor plate. Moreover, the radiation conductor plate 1 and ground conductor plate 2 are connected by through holes 4. As FIG. 5 shows, the radio wave reflectors 5*a*, 5*b* are placed along the edges of the dielectric substrate 3. Moreover, multiple through holes 4 are formed in a line along one side of the radiation conductor plate 1. The radiation conductor plate 1 is short-circuited to the ground conductor plate 2 by these through holes 4. A feeding point P is placed on the radiation conductor plate 1 in a line crossing its center point. Electric power is supplied to the feeding point P from the side of the ground conductor plate 2.

With the said microstrip antenna, the axis parallel to the radio wave reflectors that passes through the center point of the radiation conductor plate 1 is the Z axis. The axis that likewise passes through the center point of the radiation conductor plate 1 but crosses the radio wave reflectors at right angles and is parallel to the row of through holes 4 is the X axis. Finally, the axis that passes through the said center point and is perpendicular to the radiation conductor plate 1 is the Y axis.

A microstrip antenna with the said structure will radiate radio waves of roughly uniform strength from the surface (plate surface) of the radiation conductor plate 1 at all angles θ from the X axis to the Y axis. However, part of the radio waves will be reflected by the reflector surfaces 51*a*, 51*b* of the radio wave reflectors 5*a*, 5*b* and be re-radiated into space as indirect waves Wi1. The radio waves not reflected by the reflector surfaces 51*a*, 51*b* become the direct waves Wd1, which are directly radiated into space. The critical angle θO, which is the dividing point between the radiated waves, indirect waves Wi1 and direct waves Wd1, varies depending on the frequency (wavelength) of the radio wave, the length 2L of the side corresponding to the through holes 4 on the radiation conductor plate 1, the distance d between the radiation conductor plate 1 and the reflector surfaces 51*a*, 51*b*, the height h of the metal bodies 5*a*, 5*b* (that is, the height of the reflector surfaces 51*a*, 51*b*) and the like.

Due to phase differences arising from the differences in radio wave propagation distances of direct waves Wd1 and indirect waves Wi1 distant from this microstrip antenna, both waves will be strengthened in the directions where their phases are the same and weakened in the directions where their phases are opposite. The maximum angle θO (critical angle) of radio wave radiation that produces indirect waves Wi1 will increase the more the distance d between the radiation conductor plate 1 and the reflector surfaces 51*a*, 51*b* is made smaller and the more the height h of the reflector surfaces 51*a*, 51*b* is made larger. When this critical angle θO is large, the antenna gain will be decreased in the direction of the X axis and in the −Y direction. The strength of the indirect wave Wi1 will become largest at an angle θ somewhat larger than the critical angle θO, so that the difference in the antenna gain in comparison to not having the metal bodies 5*a*, 5*b* can be increased at this angle.

Figure 6:
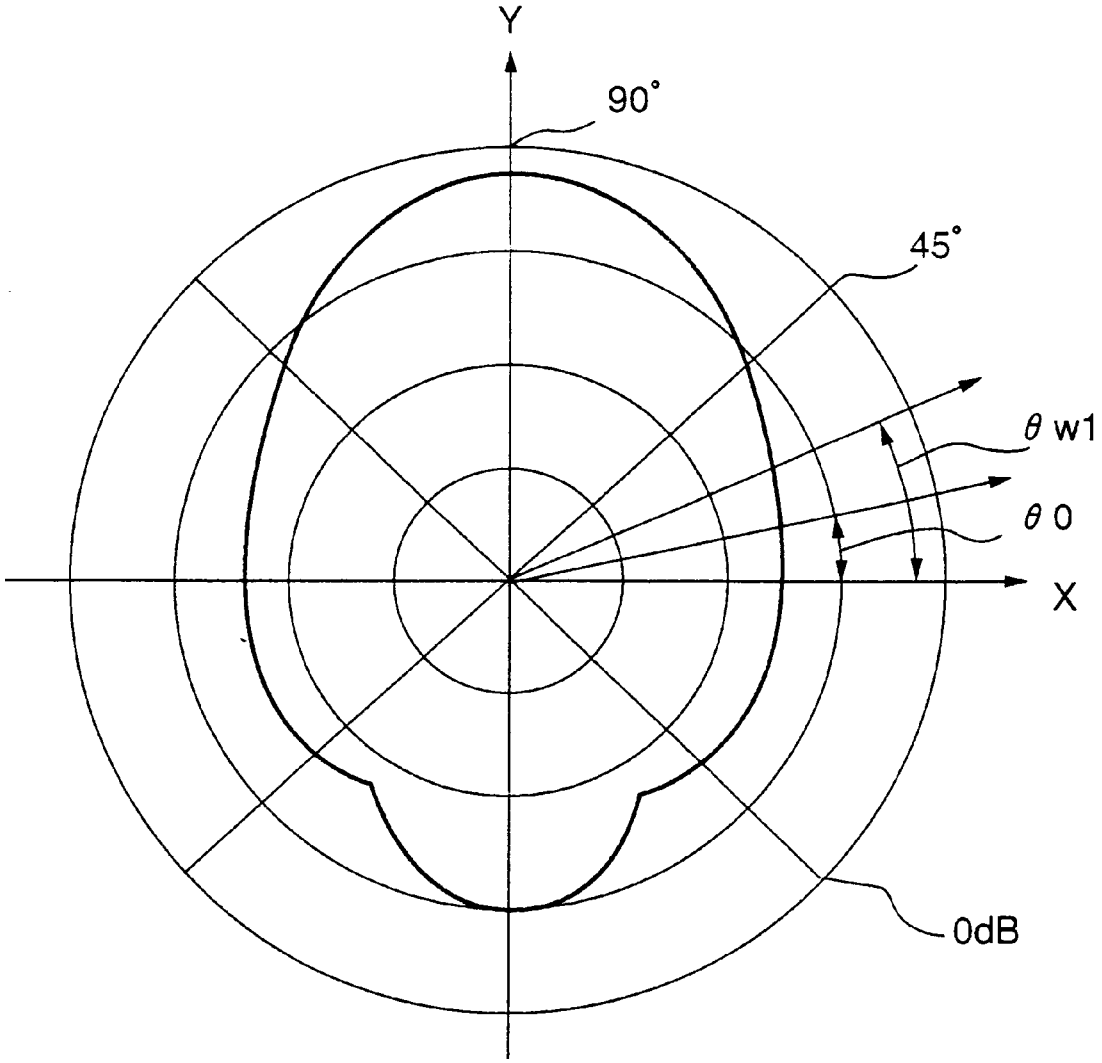
FIG. 6 is a directivity pattern of the microstrip antenna of the present invention in FIG. 4.

The directivity pattern in FIG. 6 is an example in which, simply because of the existence of the metal bodies 5*a*, 5*b*, the above parameters are set so that the direct wave Wd1 and the indirect wave Wi1 will have opposite phases in the distance at an angle θw1 somewhat larger than the critical angle θO, in addition to being able to reduce the antenna gain in the −Y direction and the X-axis direction. By appropriately setting the above parameters, the antenna gain in the Y-axis direction is increased and the antenna gain in the X-axis vicinity and in the −Y direction is decreased in comparison to the microstrip antenna of FIG. 1. At the same angle θw1, it is also possible to increase the antenna gain at angle θw1 by setting the above parameters so that direct wave Wd and indirect wave Wi are at the same phase in the distance.

As described in the above, with a microstrip antenna in the form of this embodiment it is possible to vary the antenna directivity by placing metal bodies 5*a*, 5*b* on the periphery of the radiation conductor plate 1. Moreover, in conditions where one is compelled to use the antenna in places where there is a noise source in the direction of the dielectric substrate 3 (−Y direction), it is possible to decrease the antenna gain in the −Y direction, as described above. This has the effect of making this microstrip antenna less likely to be influenced by noise than a dipole antenna, an inverted F-type antenna, or a helical antenna.

Moreover, with this antenna it is possible to change the said antenna directivity by placing the reflector surfaces 51*a*, 51*b* of the metal bodies 5*a*, 5*b* in a position at a distance d very close to the radiation conductor plate 1. This has the effect of making it possible to realize a small-size, light weight device.

Furthermore, with this antenna the metal bodies 5*a*, 5*b* are placed between the external case usually used to cover an antenna and the radiation conductor plate 1. Therefore, the metal bodies 5*a*, 5*b* have the function of acting as a spacer between the external case and the radiation conductor plate 1.

Figure 7:
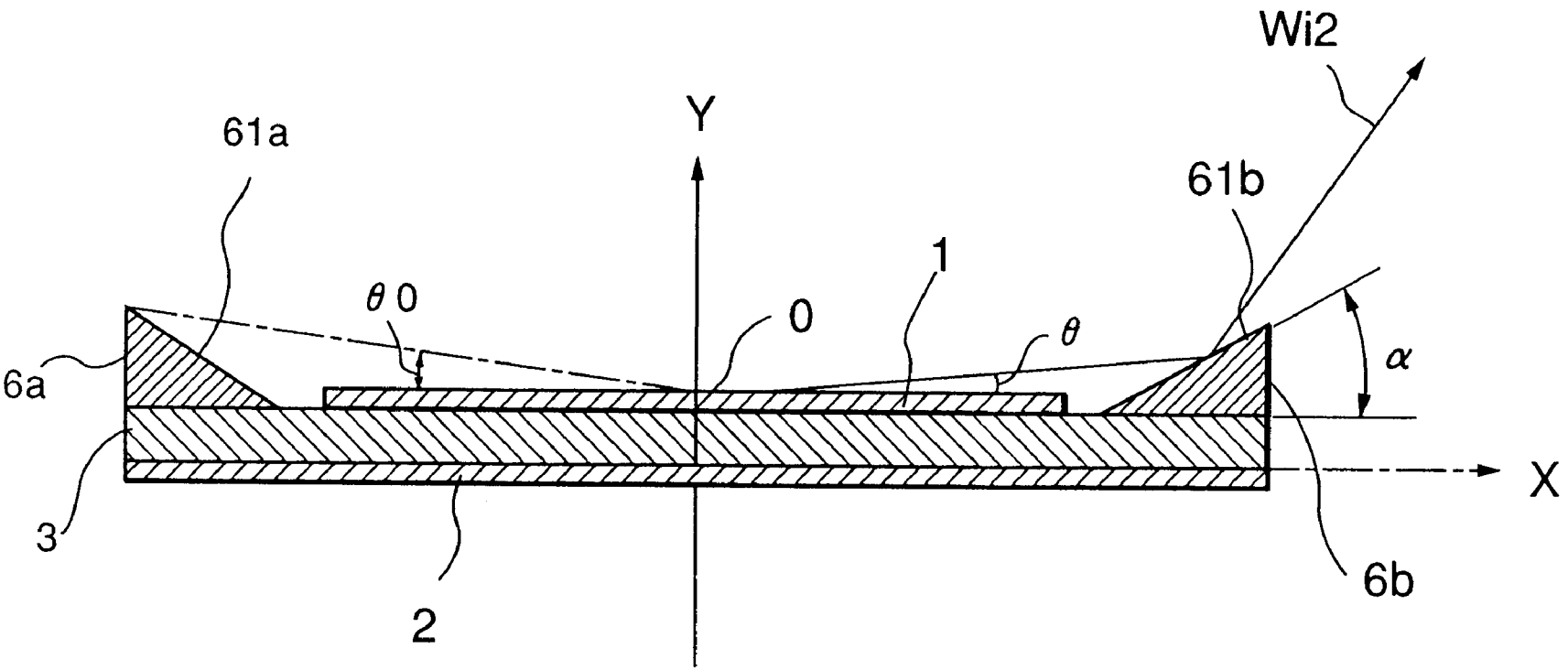
FIG. 7 is a cross-section showing another preferred embodiment of the microstrip antenna of the present invention.

The microstrip antenna in FIG. 7 is another embodiment of the present invention. Metal bodies 6*a*, 6*b* with a triangular cross section are used as the radio wave reflectors. The surface 61*a* of metal body 6*a* that faces the radiation conductor plate 1 is a plane surface formed so that it recedes in the −X direction from the radiation conductor plate 1 as it departs from the surface of the dielectric substrate 3 in the perpendicular direction. The surface 61*b* of metal body 6*b* that faces the radiation conductor plate 1 is also a plane surface formed so that it recedes in the −X direction from the radiation conductor plate 1 as it departs from the surface of the dielectric substrate 3 in the perpendicular direction. In other words, the interval between the surfaces 61*a*, 61*b* becomes larger as they depart from the dielectric substrate.

With the above antenna, from among the waves radiated from the radiation conductor plate 1, the indirect wave Wi2 will be reflected in a direction closer to the Y axis at a radio wave radiation angle θ the same as in FIG. 4. With this antenna, the angle of radiation of the indirect wave Wi2 is closest to the Y axis when the angle a formed by the reflection surfaces 61*a*, 61*b* in relation to the X axis is has the effect of making this microstrip antenna less likely close to 45 degrees. In other words, it is possible to make the variation in antenna gain in the Y-axis direction larger at that time.

Figure 8:
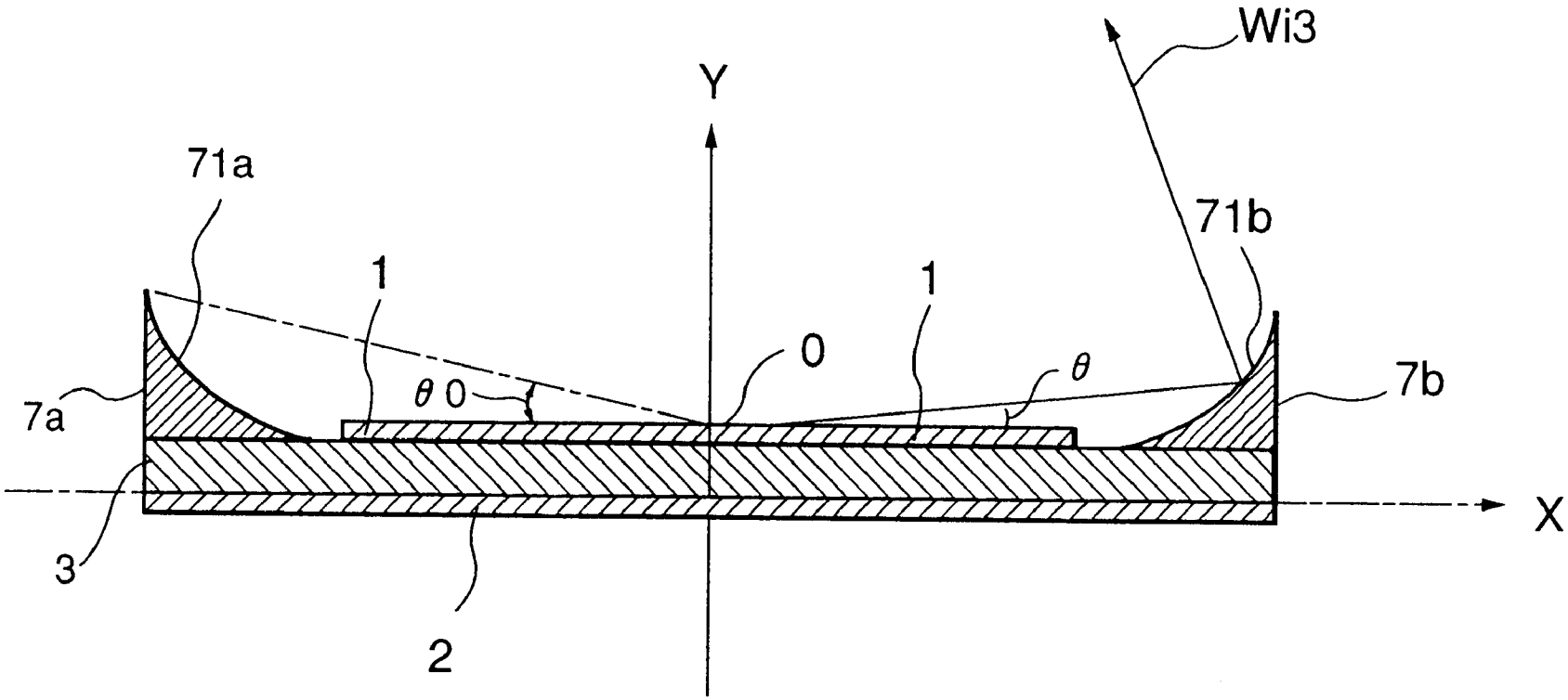
FIG. 8 is a cross-section showing another preferred embodiment of the microstrip antenna of the present invention.

In the microstrip antenna of FIG. 8, the reflection surfaces 71*a*, 71*b* of the metal bodies 7*a*, 7*b*, which are the radio wave reflectors, are formed of curved concave surfaces in a form so that they each recede away from the radiation conductor plate 1 as they depart from the surface of the dielectric substrate 3 in the perpendicular direction.

With this microstrip antenna structure, as the radio wave radiation angle θ increases, the radiation angle of the indirect wave Wi3, which is radiated from the radiation conductor plate 1, changes from the X-axis direction to the Y-axis direction to an extent greater than the variation in the radio wave radiation angle θ. This antenna has a structure with which the strength of the indirect wave Wi3 increases in the Y-axis direction (large elevation angle direction). Therefore, this antenna has the characteristic of being able to increase the variation in antenna gain in the Y-axis direction.

In the microstrip antenna of FIG. 9, the reflection surfaces 81*a*, 81*b* of the metal bodies 8*a*, 8*b*, which are the radio wave reflectors, are structured in a step-like shape as they depart from the surface of the dielectric substrate 3 in the perpendicular direction. By making the reflection surfaces 81*a*, 81*b* of the metal bodies have a step-like shape, the energy of the said indirect wave can be increased even more. This makes it possible to further increase the change in the antenna directivity of the microstrip antenna.

In the embodiments of the present invention, the metal bodies are placed only on the sides at right angles to the row of through holes 4. However, the said metal bodies may of course be placed parallel to the said parallel side of the radiation conductor plate 1 so that they surround the side parallel to the through holes 4. In this case, it is possible to change the antenna directivity of the microstrip antenna in the Z-axis direction.

The microstrip antenna of the present invention, as explained above, can vary the antenna directivity in the desired direction by placing radio wave reflectors in the vicinity of the radiation conductor plate. For this reason, the antenna is less likely to be influenced by noise generated from noise sources in its surroundings, in comparison to other antennas.

Moreover, since the said radio wave reflectors are placed at a distance extremely close to the said radiation conductor plate, this has the effect of enabling a small size, light weight device to be achieved.

Furthermore, with this antenna device, the said metal bodies are placed between the outer case and the said radiation conductor plate so that a spacer is positioned between the outer case and radiation conductor plate. This has the effect of providing protection against external pressure from outside the external case and of providing protection against damage from breakage of the external case and the like.

The microstrip antenna as explained above is basically manufactured using the same manufacturing methods as multi-layer circuit boards. In short, the basic structure of the antenna of the present invention is made by copper plating or etching on both sides of a glass epoxy or ceramic substrate. It is not necessary to use the same material for the radiation conductor plate and the ground conductor plate. The radiation conductor plate may be a foil made of a material with high conductivity such as silver or gold, while a steel foil may be used for the ground conductor plate. When adopting a radio wave of about 1 GHz and a dielectric plate with 2–3 of dielectric constant, the antenna may be a square or a rectangle with a ground conductor plate of about 8 cm to 10 cm to a side and a radiation conductor plate of about 7 cm to 8 cm to a side. In the case that the ground conductor plate is a rectangle, it is possible for its length to be from about 7 cm to 8 cm from the side in the vicinity of the through hole line to the opposite side, and for the interval on the two sides along the radio wave reflectors to be from about 2 cm to 3 cm. The thickness of the dielectric substrate, though dependent on the dielectric constant of the material, may be from about 1 mm to 2 mm. The thickness of the ground conductor plate and radiation conductor plate may be about 0.5 mm to 1 mm. The radio wave reflectors may be gold or silver, for example, plated onto a square steel or copper bar with a cross section of about 1 cm. The radio wave reflectors and dielectric substrate are adhered using adhesives. The interval d between the radio wave reflectors and the radiation conductor plate may be about 5 mm to 10 mm.

As processes for forming the through holes, one method is to form through holes in the dielectric substrate and then plate the interiors; another method is to place conductors on the through holes. Furthermore, the feeding line is insulated from the ground conductor plate on the side of the ground conductor plate and led from the feeding point on the radiation conductor plate.

While the present invention has been described in connection with certain preferred embodiments, it is to be understood that the subject matter encompassed by the present invention is not limited to those specific embodiments. On the contrary, it is intended to include all alternatives, modifications, and equivalents as can be included within the spirit and scope of the following claims.

I claim:

1. A microstrip antenna, comprising:

a dielectric substrate;

a ground conductor plate on one surface of said dielectric substrate;

a radiation conductor plate on a central part on the opposite surface of said dielectric substrate, the radiation conductor plate has an area smaller than that of said ground conductor plate and is short-circuited to said ground conductor plate and connected to a feeding line; and radio wave reflectors each having upward facing reflective surfaces reflecting part of the radio waves radiating from said radiation conductor plate, said radio wave reflectors being positioned on said dielectric substrate and on opposing sides of said radiation conductor plate, said reflective surfaces face each other and said radiation conductor plate, and a distance between the upward facing reflective surfaces of said radio wave reflectors increase toward a periphery of said dielectric substrate.

2. A microstrip antenna as stated in claim 1 wherein the upward facing reflective surfaces of the radio wave reflectors that are facing each other are planar surfaces.

3. A microstrip antenna as stated in claim 1 wherein the upward facing reflective surfaces of the radio wave reflectors that are facing each other are curved surfaces.

4. A microstrip antenna as stated in claim 1 wherein the upward facing reflective surfaces of the radio wave reflectors that are facing each other are each formed in a step-like shape.

* * * * *